US008651834B2

(12) United States Patent
Lee et al.

(10) Patent No.: US 8,651,834 B2
(45) Date of Patent: Feb. 18, 2014

(54) LINEAR COMPRESSOR

(75) Inventors: Jong-Koo Lee, Changwon-si (KR); Seong-Yeol Hyeon, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 538 days.

(21) Appl. No.: 12/739,377

(22) PCT Filed: Oct. 9, 2008

(86) PCT No.: PCT/KR2008/005948
§ 371 (c)(1),
(2), (4) Date: Sep. 1, 2010

(87) PCT Pub. No.: WO2009/054627
PCT Pub. Date: Apr. 30, 2009

(65) Prior Publication Data

US 2010/0316513 A1 Dec. 16, 2010

(30) Foreign Application Priority Data

Oct. 24, 2007 (KR) ..... 10-2007-0107377
Oct. 24, 2007 (KR) ..... 10-2007-0107379

(51) Int. Cl.
*F04B 35/04* (2006.01)
*F04B 17/04* (2006.01)
*F04B 17/00* (2006.01)

(52) U.S. Cl.
USPC ..... 417/417; 417/363

(58) Field of Classification Search
USPC ..... 417/363
See application file for complete search history.

(56) References Cited

U.S. PATENT DOCUMENTS

| | | | | |
|---|---|---|---|---|
| 6,435,842 | B2 * | 8/2002 | Song | 417/363 |
| 7,028,601 | B2 * | 4/2006 | Yoon et al. | 92/130 C |
| 7,124,678 | B2 * | 10/2006 | Lee et al. | 92/140 |
| 7,331,772 | B2 * | 2/2008 | Jung et al. | 417/417 |
| 7,626,289 | B2 * | 12/2009 | Her | 310/12.04 |
| 8,303,273 | B2 * | 11/2012 | Kang et al. | 417/416 |
| 8,317,495 | B2 * | 11/2012 | Kang et al. | 417/417 |
| 2001/0043870 | A1 | 11/2001 | Song | |
| 2005/0142007 | A1 | 6/2005 | Lee et al. | |

(Continued)

FOREIGN PATENT DOCUMENTS

| | | |
|---|---|---|
| CN | 1443280 | 9/2003 |
| EP | 1553294 | 7/2005 |
| KR | 2002009004 | 11/2001 |
| KR | 10-2002-0064838 | 8/2002 |

(Continued)

*Primary Examiner* — Peter J Bertheaud
(74) *Attorney, Agent, or Firm* — McKenna Long & Aldridge LLP

(57) ABSTRACT

A linear compressor comprises: a fixed member including a cylinder for providing a refrigerant compression space; a movable member, which includes a piston for compressing refrigerant inside the cylinder and a supporter composed of a center portion being aligned with a center of the piston and a support portion extended radially of the piston and which makes a linear reciprocating movement about the fixed member; a plurality of mainsprings supported on the support portion of the supporter, for elastically supporting the piston in an axial direction; and a mass member, which includes a center portion to couple with the center portion of the supporter and a plurality of ends extended from the center portion to maintain an air-gap towards the support portion of the supporter and towards the mainsprings. The linear compressor of the present invention can accommodate a maximum mass member in a defined space of a linearly reciprocating movable member, so material loss is prevented and more installation space can be secured.

12 Claims, 7 Drawing Sheets

(56) References Cited

U.S. PATENT DOCUMENTS

| | | | | |
|---|---|---|---|---|
| 2005/0142008 | A1* | 6/2005 | Jung et al. | 417/417 |
| 2006/0093495 | A1 | 5/2006 | Oh et al. | |
| 2006/0093498 | A1* | 5/2006 | Kim | 417/417 |
| 2006/0127250 | A1* | 6/2006 | Park et al. | 417/417 |
| 2006/0250032 | A1* | 11/2006 | Her | 310/13 |
| 2009/0252625 | A1 | 10/2009 | Lee et al. | |

FOREIGN PATENT DOCUMENTS

| | | |
|---|---|---|
| KR | 2002-0064838 | 8/2002 |
| KR | 20030073662 | 9/2003 |
| KR | 1020050029411 | 3/2005 |
| KR | 10-0746429 | 7/2007 |
| KR | 1020070075901 | 7/2007 |
| WO | WO 2005/040611 | 5/2005 |
| WO | WO 2007/046592 | 4/2007 |

* cited by examiner

LINEAR COMPRESSOR

This application claims priority to PCT/KR2008/005948 filed on Oct. 9, 2008, and Korean Application Nos. 10-2007-0107377 and 10-2007-0107379, filed on Oct. 24, 2007, in Korea, all of which are hereby incorporated by reference in their entirety.

TECHNICAL FIELD

The present invention relates in general to a linear compressor, and more particularly, to a linear compressor that can accommodate a maximum mass member in a defined space of a linearly reciprocating movable member.

In addition, the present invention relates to a linear compressor featuring enhanced assembly efficiency of components that constitute the movable member.

BACKGROUND ART

In general, a reciprocating compressor is designed to form a compression space to/from which an operation gas is sucked/discharged between a piston and a cylinder, and the piston linearly reciprocates inside the cylinder to compress refrigerants.

Most reciprocating compressors today have a component like a crankshaft to convert a rotation force of a drive motor into a linear reciprocating drive force for the piston, but a problem arises in a great mechanical loss by such motion conversion. To solve the problem, development of linear compressors is still under progress.

Linear compressors have a piston that is connected directly to a linearly reciprocating linear motor, so there is no mechanical loss by the motion conversion, thereby not only enhancing compression efficiency but also simplifying the overall structure. Moreover, since their operation is controlled by controlling an input power to a linear motor, they are much less noisy as compared to other compressors, which is why linear compressors are widely used in indoor home appliances such as a refrigerator.

FIG. 1 illustrates one example of a linear compressor in accordance with a prior art. The linear compressor has an elastically supported structure inside a shell (not shown), the structure including a frame 1, a cylinder 2, a piston 3, a suction valve 4, a discharge valve assembly 5, a linear motor 6, a motor cover 7, a supporter 8, a body cover 9, mainsprings S1 and S2, a muffler assembly 10, and a mass member 20.

The cylinder 2 is insertedly fixed to the frame 1, and the discharge assembly 5 constituted by a discharge valve 5*a*, a discharge cap 5*b*, and a discharge valve spring 5*c* is installed to cover one end of the cylinder 2. The piston 3 is inserted into the cylinder 2, and the suction valve 4 which is very thin is installed to open or close a suction port 3*a* of the piston 2.

The linear motor 6 is installed in a manner that a permanent magnet 6*c* linearly reciprocates while maintaining the gap between an inner stator 6*a* and an outer stator 6*b*. To be more specific, the permanent magnet 6*c* is connected to the piston 3 with a connecting member 6*d*, and an interactive electromagnetic force between the inner stator 6*a*, the outer stator 6*b*, and the permanent magnet 6*c* makes the permanent magnet 6*c* linearly reciprocating to actuate the piston 3.

The motor cover 7 supports the outer stator 6*b* in an axial direction to fix the outer stator 6*b* and is bolted to the frame 1. The body cover 9 is coupled to the motor cover 7, and between the motor cover 7 and the body cover 9 there is the supporter 8 that is connected to the other end of the piston 3, while being elastically supported in an axial direction by the mainsprings S1 and S2. The muffler assembly 10 for sucking in refrigerant is also fastened to the supporter 8.

Here, the mainsprings S1 and S2 consist of four front springs S1 and four rear springs S2 that are arranged in horizontally and vertically symmetrical positions about the supporter 8. As the linear motor 6 starts running, the front springs S1 and the rear springs S2 move in opposite directions and buff the piston 3 and the supporter 8. In addition to these springs, the refrigerant in the compression space P functions as sort of a gas spring to buff the piston 3 and the supporter 8.

Therefore, when the linear motor 6 starts running, the piston and the muffler assembly 10 connected to it move in a linear reciprocating direction, and with the varying pressure in the compression space P the operation of the suction valve 4 and the discharge valve assembly 5 are automatically regulated. Under this mechanism, the refrigerant flows via a suction pipe on the side of the shell, an opening of the body cover 9, the muffler assembly 10, and suction ports 3*a* of the piston 3 until it is sucked in the compression space P and compressed. The compressed refrigerant then escapes to the outside through the discharge cap 5*b*, the loop pipe and an outlet duct on the side of the shell.

FIG. 2 illustrates one example of a mass member installation structure for a linear compressor in accordance with a prior art. As one example, a mass member 20 is fastened with a piston 3, a muffler assembly 10, and a supporter 8 by bolts B. The piston 3 is provided with suction ports 3*a* at a closed end, and a radially extending flange 3*b* with four bolt holes 3h at the other open end. The muffler assembly 10 is inserted in part to the piston 3, and the other part is exposed to the rear side of the supporter 8 to be fastened with the flange 3*b* of the piston 3 by bolts B. The supporter 8 includes a circular center portion 8*a* that faces the flange 3*b* of the piston 3, thereby coupling to the rear side of the flange 3*b* , and a pair of front and rear supports 8*b*, 8*e*, 8*d* and 8*c* around the center portion 8*a*. The mass member 20 takes a nearly annular shape, correspondingly to the flange 3*b* of the piston 3 and to the center portion 8*a* of the supporter 8. The mass member 20 also couples to the rear side of the center portion 8*a* of the supporter 8. To this end, four bolts B are fastened one by one in the direction where the front and rear supports 8*b*, 8*d*, 8*e*, and 8*c* of the supporter 8 are formed.

FIG. 3 illustrates a detailed view of the mass member in FIG. 2, which is adapted to a linear compressor in accordance with a prior art. Referring to FIG. 2 and FIG. 3, the overall shape of the mass member 20 is annular, the center of which has a hole 21 to receive a muffler assembly 10, and four bolt holes 22*a*, 22*b*, 22*c*, and 22*d* are formed in the circumferential direction to join with the front and rear supports 8*b*, 8*d*, 8*e*, and 8*c* of the supporter 8 by bolts B in a one-to-one correspondence. Since the mass member 20 together with the piston 3, the supporter 8, and the muffler assembly 10, constitute sort of a linearly reciprocating movable member, four resistance dissipating holes 23*a*, 23*b*, 23*c*, and 23*d* are formed between the hole 21 and each of the bolt holes 22*a*, 22*b*, 22*c*, and 22*d*, so as to lessen the drift resistance during the linear reciprocating motion. Needless to say, the mass member 20 is made in the same annular shape with the center portion 8*a* of the supporter 8 by cutting a scrap 'a' out of a square sheet metal A to form a laminate structure that consists of multilayers of the same shape with various thickness.

The mass member 20 is originally added to increase a total mass of the movable member. Because the movable member in a linear compressor adopts sort of a resonant system that is elastically supported by front/rear mainsprings S1 and S2 (see FIG. 1) and a high-pressure refrigerant gas spring, resonance frequency of the linear compressor needs to match operating frequency of the linear motor 6 (see FIG. 1), which is achieved by adjusting the mass of the movable member with the help of the mass member 20 added to the movable member, instead of adjusting stiffness of easily spreading springs.

However, since the mass member adapted to the conventional linear compressor takes the annular form to be coupled to the circular center portion of the supporter and is given a lot of holes to meet diverse needs, it poses problems in terms of a waste of materials caused by scraping action to obtain an annular mass member out of a square raw material, and low mass despite a high amount of materials being used. Unfortunately though, if the mass member is made thicker to secure a sufficiently large mass as compared with the amount of consumed materials, it would naturally occupy more installation space; while if the mass member is made larger in the radial direction, it not only becomes harder to assemble with a component such as a supporter in the opposite direction, but also creates interference with neighboring components during the operation, thereby impairing the operation reliability.

FIG. 4 and FIG. 5 illustrate one example of a movable member assembly structure adapted to a linear compressor in accordance with a prior art. Here, the movable member is assembled to make a linear reciprocating movement in an axial direction, and includes a piston 3, a connecting member 6*d* provided with a permanent magnet 6*c*, a supporter 8, a muffler assembly 10, and a mass member 20. The flange of the piston 3, the connecting member 6*d*, the supporter 8, the muffler assembly 10, and the mass member 20 each have two bolt holes 3*h*, 6*h*, 8*h*, 10*h*, and 20*h* to join with each other by bolts B, and a coupling boss 3*a* is formed in an axial direction at the internal diameter of the flange of the piston 3 to achieve a smooth fit.

Therefore, the movable member is assembled with a jig Z, and the flange of the piston 3 sealingly fits into a piston holder Z1. A connecting member is settled on the rear side of the piston 3 to make the coupling boss 3*a* of the piston 3 slid into the inner diameter of the connecting member 6*d* having the permanent magnet 6*c*, and then the supporter 8 is settled on the rear side of the connecting member 6*d* to make the coupling boss 3*a* of the piston 3 slid into the inner diameter of the supporter 8 and two supports 8*a* and 8*b* of the supporter 8 are settled on two supporter holding protrusions Z2 and Z3 at the same time. Moreover, the muffler assembly 10 is settled on the rear side of the supporter 8, and part of the muffler assembly 10 is inserted into the inner diameter of the mass member 20, thereby allowing the mass member 20 to settle on the rear side of the muffler assembly 10. As such, when the piston 3, the connecting member 6*d* having the permanent magnet 6*c*, the supporter 8, the muffler assembly 10, and the mass member 20 are all positioned at their proper positions, they are joined together by fastening bolts B into the bolt holes 3*h*, 6*h*, 8*h*, 10*h*, and 20*h*, respectively.

However, a problem arises in the conventional linear compressor because the presence of the permanent magnet provided to the connecting member magnetizes its neighboring components such as the piston, the supporter, etc., so it is not easy to assemble such components of the movable member at accurate positions. Although a separate coupling boss could be formed at the inner diameter of the flange of the piston and the connecting member and the supporter could be inserted into the coupling boss of the piston for proper positioning, it is still difficult to make other components such as the muffler assembly and the mass member stay at their positions. Overall, the assembly efficiency is therefore deteriorated.

Moreover, despite the fact that the coupling boss of the piston is required only for assembly of the piston, it is produced by processing with narrow tolerance. This consequently increases material cost and processing cost, thereby contributing to an increase in manufacturing costs.

DISCLOSURE OF INVENTION

Technical Problem

The present invention is conceived to solve the aforementioned problems in the prior art. It is, therefore, an object of the present invention to provide a linear compressor that can accommodate a maximum mass member in a defined space of a linearly reciprocating movable member.

Another object of the present invention is to provide a linear compressor that is designed to facilitate the assembly of all components of a linearly reciprocating movable member at their accurate positions.

A still another object of the present invention is to provide a linear compressor that can achieve high assembly efficiency or assembly convenience of all components of a linearly reciprocating movable member at the cost of less use of additional materials and reduced processes.

Technical Solution

According to an aspect of the present invention, there is provided a linear compressor, comprising: a fixed member including a cylinder for providing a refrigerant compression space; a movable member, which includes a piston for compressing refrigerant inside the cylinder and a supporter composed of a center portion being aligned with a center of the piston and a support portion extended radially of the piston and which makes a linear reciprocating movement about the fixed member; a plurality of mainsprings supported on the support portion of the supporter, for elastically supporting the piston in an axial direction; and a mass member, which includes a center portion to couple with the center portion of the supporter and a plurality of ends extended from the center portion to maintain an air-gap towards the support portion of the supporter and towards the mainsprings.

In an exemplary embodiment, the supporter includes at least two front supports that are two-stage bent to extend backwards and in a radial direction from the center portion, and at least two rear supports extended radially from the center portion, the mainsprings are composed of a plurality of front mainsprings that are supported on the fixed member and the front supports, and a plurality of rear mainsprings that are supported on the fixed member and the rear supports, and wherein the mass member includes at least four ends to maintain an air-gap towards the front supports and towards the rear mainsprings.

The mass member further includes a plurality of mounting grooves at the ends that are provided to maintain an air-gap towards the rear mainsprings, thereby enabling installation of the rear mainsprings.

The mass member further includes a plurality of resistance dissipating holes inside the ends that are provided to maintain an air-gap towards the front supports, thereby reducing drift resistance.

For a bolted-joint with the piston and the supporter, the mass member further includes a plurality of bolt holes between the ends provided to maintain an air-gap towards the rear mainsprings and between the ends provided to maintain an air-gap towards the front supports.

To match joining positions of the piston and supporter, the piston and the supporter each have guide holes formed in an axial direction to let guide pins inserted therein, and the mass member further includes guide grooves that are formed in the ends to maintain an air-gap towards guide pins.

The center portion of the support is formed in a rectangular shape longer in a direction where the front supports are formed than in a direction where the rear supports are formed, and the mass member has a shape corresponding to the center portion of the supporter.

Another aspect of the present invention provides a linear compressor, comprising: a cylinder for providing a refrigerant compression space; a piston, which linearly reciprocates back and forth to compress refrigerant; and a supporter fastened to the flange of the piston and elastically supported in an axial direction. In order to secure joining positions during an assembly process, the piston and the supporter each have at least two guide holes communicating with each other in an axial direction to let guide pins inserted therein.

Also, the linear compressor further comprises: a linear motor, which includes an inner stator secured to the outer periphery of a cylinder, an outer stator installed at a predetermined distance away from the inner stator in a radial direction, and a permanent magnet installed between the inner stator and the outer stator to maintain an air-gap between them, the permanent magnet linearly reciprocating in an axial direction by an interactive electromagnetic force; and a connecting member fastened between the piston and the supporter, for connecting the permanent magnet and the piston. Moreover, the connecting member includes guide holes at positions corresponding to the guide holes of the piston.

The linear compressor further comprises a mass member fastened to the rear side of the supporter, for increasing a total mass of a movable member that linearly reciprocates in an axial direction, and the mass member includes guide holes or guide grooves at positions corresponding to the guide holes of the supporter.

In one exemplary embodiment, the linear compressor further comprises a suction muffler fastened between the supporter and the mass member, for guiding the flow of refrigerant to the piston, in which the suction muffler includes guide holes at positions corresponding to the guide holes of the supporter.

The supporter includes a polygonal center portion aligned with the center of the piston, at least two front supports that are two-stage bent to extend backwards and in a radial direction from the center portion, and at least two rear supports extended radially from the center portion, the guide holes of the supporter are formed between the center portion and the rear supports.

Yet another aspect of the present invention provides a linear compressor comprising: a cylinder for providing a refrigerant compression space; a piston, which linearly reciprocates back and forth to compress refrigerant and which includes a flange on the rear side; a supporter fastened to the flange of the piston and elastically supported in an axial direction; a connecting member, which is coupled between the piston and the supporter and which includes permanent magnets arranged in a circumference direction; and a suction muffler, which includes a connecting part fastened the rear side of the supporter and which guides the flow of refrigerant to the piston, wherein the flange of the piston, the supporter, the connecting member, and the connecting part of the suction muffler each have at least two guide holes communicating with each other in an axial direction such that guide pins are inserted therein for accurate joining positioning of the components during an assembly process.

The linear compressor further comprises a mass member fastened to the rear side of the connecting part of the suction muffler, for increasing a total mass of a linearly reciprocating member in an axial direction, and the mass member includes guide holes or guide grooves at positions corresponding to the guide holes on the connecting part side of the suction muffler.

Advantageous Effects

In the linear compressor in accordance with the present invention, a piston, a muffler assembly, a supporter and a mass member are bolt joined to each other to configure a movable member, in which the mass member takes the form of a polygonal shape with plural ends to maintain an air-gap towards its neighboring components, such that an overall cost of manufacturing can be reduced by preventing a waste of materials for producing the mass member, and that the mass member has a sufficient mass considering the amount of materials used to reduce installation space. Furthermore, the mass member is safe not only from interference of its counterpart during the assembly, but also from interference of other neighboring components during the operation, thereby securing the operating reliability.

In addition, since all the components like a piston, a connecting member provided with permanent magnet, a supporter, a suction muffler and a mass member that constitute a movable member have their own guide holes or guide grooves, they are more likely to stay at accurate joining positions with guide pins being inserted into those guide holes or guide grooves during the assembly process of the components, which in turn facilitates the assembly by bolts and increases the productivity.

Moreover, it only takes guide holes or guide grooves in the components like a piston, a connecting member provided with permanent magnet, a supporter, a suction muffler and a mass member to achieve the convenience in assembly of components of a movable member of a linear compressor in accordance with the present invention, and no additional materials or process are required. Thus, an overall cost of manufacturing can be reduced.

MODE FOR THE INVENTION

Hereinafter, preferred embodiments of the present invention will be described in detail with reference to the accompanying drawings.

Figure 6:
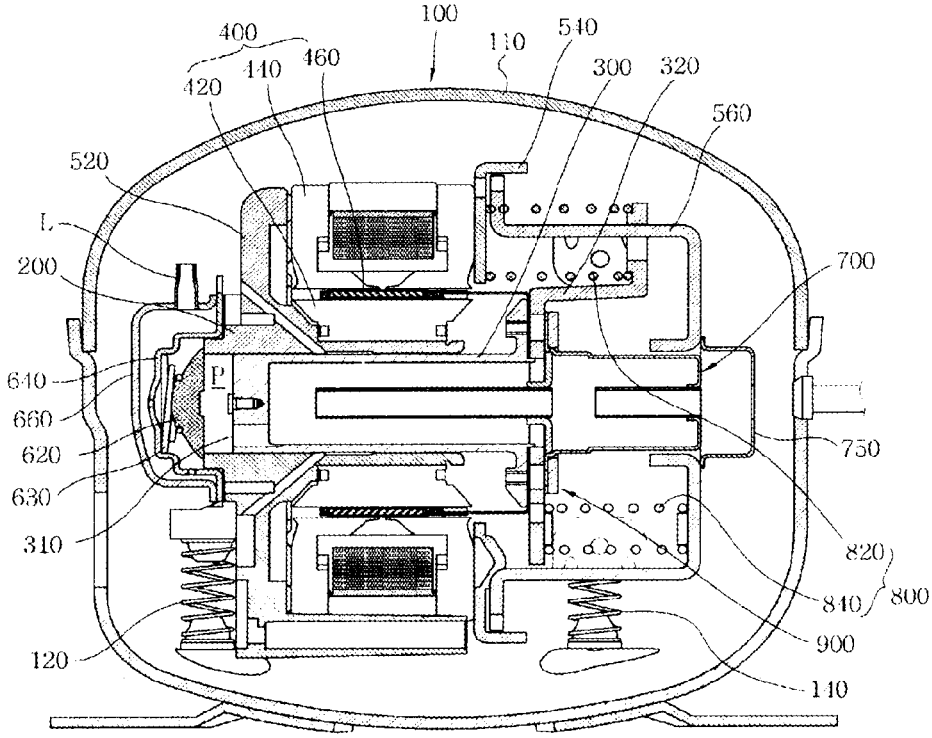
FIG. 6 illustrates a linear compressor in accordance with one embodiment of the present invention.

FIG. 6 illustrates a linear compressor in accordance with one embodiment of the present invention. One embodiment of a linear compressor 100 in accordance with the present invention includes a cylinder 200, a piston 300, a linear motor 400 provided with an inner stator 420, an outer stator 440, and a permanent magnet 460, and a mass member 900, each being housed in a shell 110 serving as a hermetic casing. When the permanent magnet 460 linearly reciprocates by an interactive electromagnetic force between the inner stator 420 and the outer stator 440, the piston 300 connected to the permanent magnet 460 engagedly moves along the permanent magnet 460, making a linear reciprocating movement.

Figure 1:
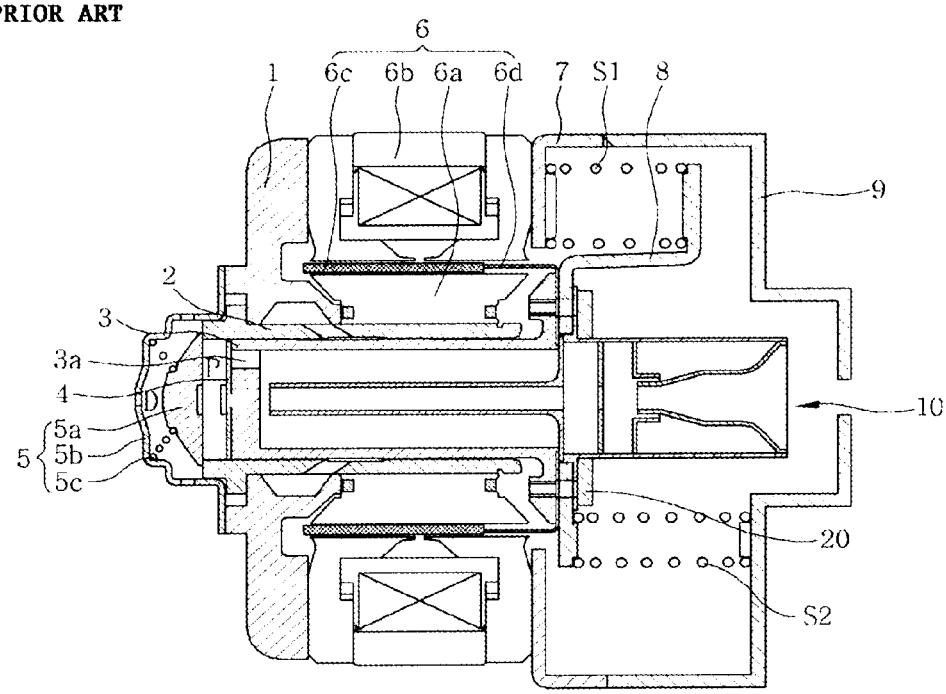
Fig. 1 PRIOR ART
FIG. 1 illustrates one example of a linear compressor in accordance with a prior art.
Figure 2:
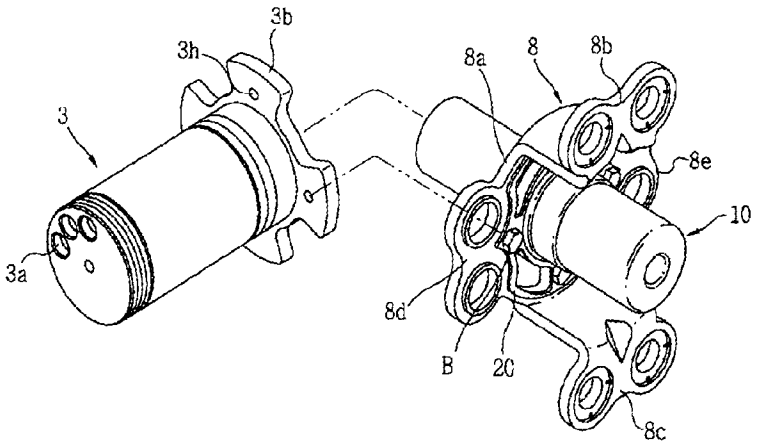
Fig. 2 PRIOR ART
FIG. 2 illustrates one example of a mass member installation structure for a linear compressor in accordance with a prior art.
Figure 3:
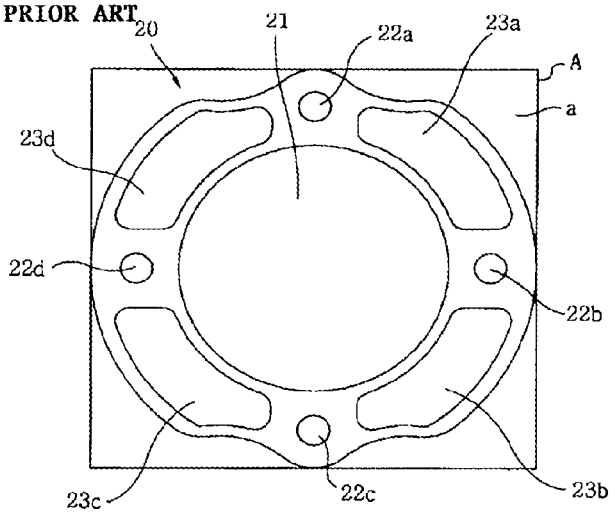
Fig. 3 PRIOR ART
FIG. 3 illustrates one example of a mass member adapted to a linear compressor in accordance with a prior art.
Figure 4:
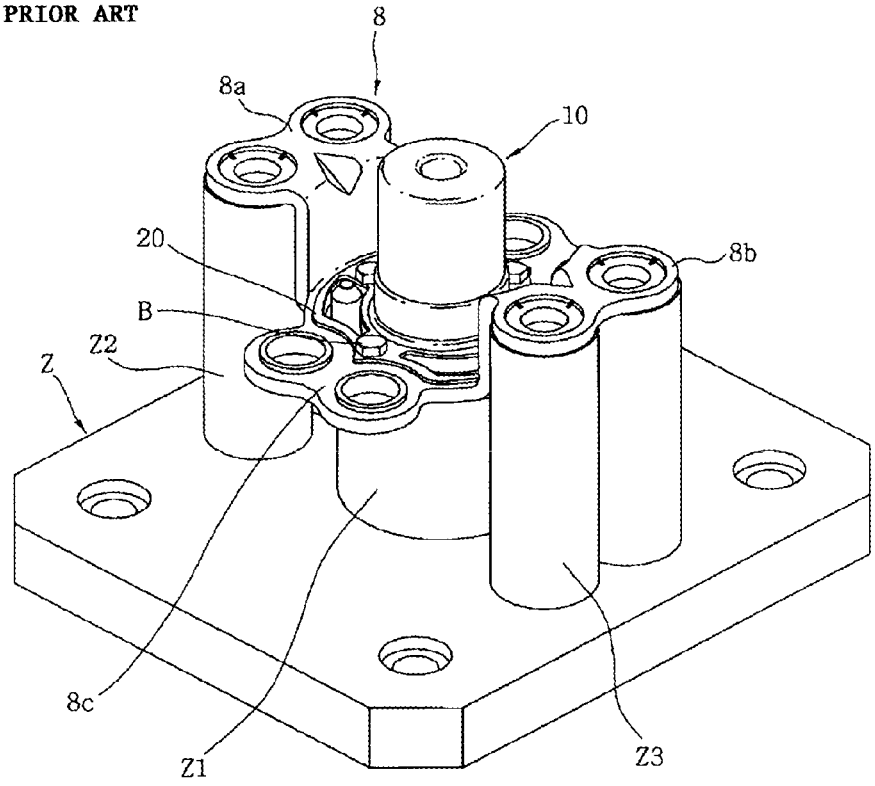
Fig. 4 PRIOR ART
FIG. 4 and FIG. 5 illustrate one example of a movable member assembly structure adapted to a linear compressor in accordance with a prior art.
Figure 5:
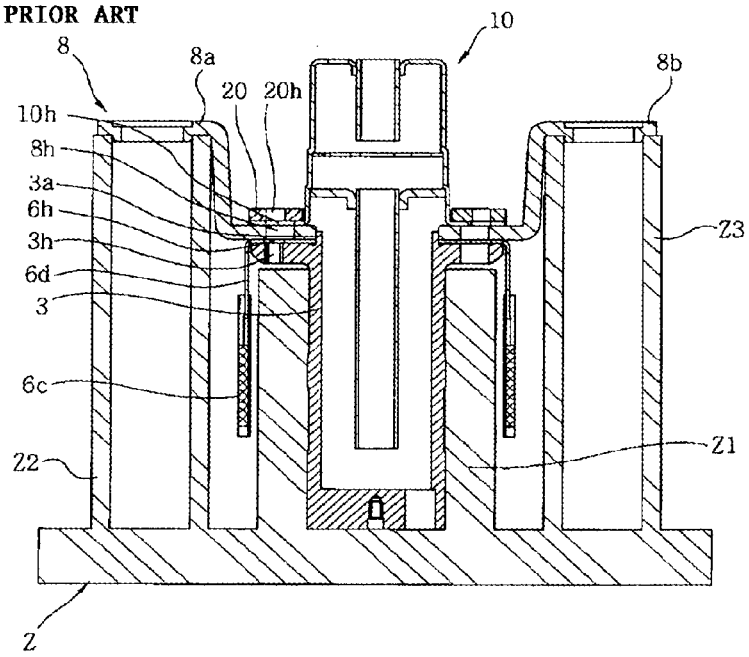
Fig. 5 PRIOR ART

The inner stator 420 is affixed to an outer periphery of the cylinder 200, and the outer stator 440 is secured axially by a frame 520 and a motor cover 540. The frame 520 and the motor cover 540 are joined together by fastening members such as bolts, and the outer stator 440 is secured between the frame 520 and the motor cover 540. The frame 520 may be integrately formed with the cylinder 200, or the frame 520 may be manufactured separately and then coupled to the cylinder 200 later. The embodiment in FIG. 4 shows an example where the frame 520 and the cylinder 200 are integrated as one body.

The supporter 320 is connected to the rear side of the piston 300. Four front mainsprings 820 are supported on both ends by the supporter 320 and the motor cover 540. Also, four rear mainsprings 840 are supported on both ends by the supporter 320 and a back cover 560, and the back cover 560 is coupled to the rear side of the motor cover 540. A suction muffler 700 is provided on the rear side of the piston 300, through which refrigerant flows into the piston 300, so less noise is generated during suction feeding.

The interior of the piston 300 is hollowed to let the refrigerant which is fed through the suction muffler 700 introduced and compressed in a compression space P defined between the cylinder 200 and the piston 300. A suction valve 310 sits at the front end of the piston 300. The suction valve 310 in the open position allows the refrigerant to flow from the piston 300 into the compression space P, and it shuts the front end of the piston 300 to prevent backflow of the refrigerant from the compression space P to the piston 300.

When refrigerant inside the compression space P is compressed to a predetermined level or higher, it causes a discharge valve 620 which is seated at the front end of the cylinder 200 to open. The discharge valve 620 is elastically supported by a spiral discharge valve spring 630 inside a support cap 640 that is secured to one end of the cylinder 200. The high-pressure compressed refrigerant is then discharged into a discharge cap 660 via a hole which is formed in the support cap 640, and then escapes from the linear compressor 110 via a loop pipe L to be circulated, thereby making the refrigeration cycle work.

All of the components of the linear compressor 100 described above are supported by front and rear support springs 120 and 140 in assembled state, and stay at a certain distance away from the bottom of the shell 110. Since they are not in direct contact with the bottom of the shell 110, the shell 110 is free from the influence of vibrations that are produced by each component of the compressor 100 when compressing refrigerant. As a result, less vibration is delivered to the outside of the shell 110 and therefore, less noise is created due to the vibration of the shell 110.

Figure 7:
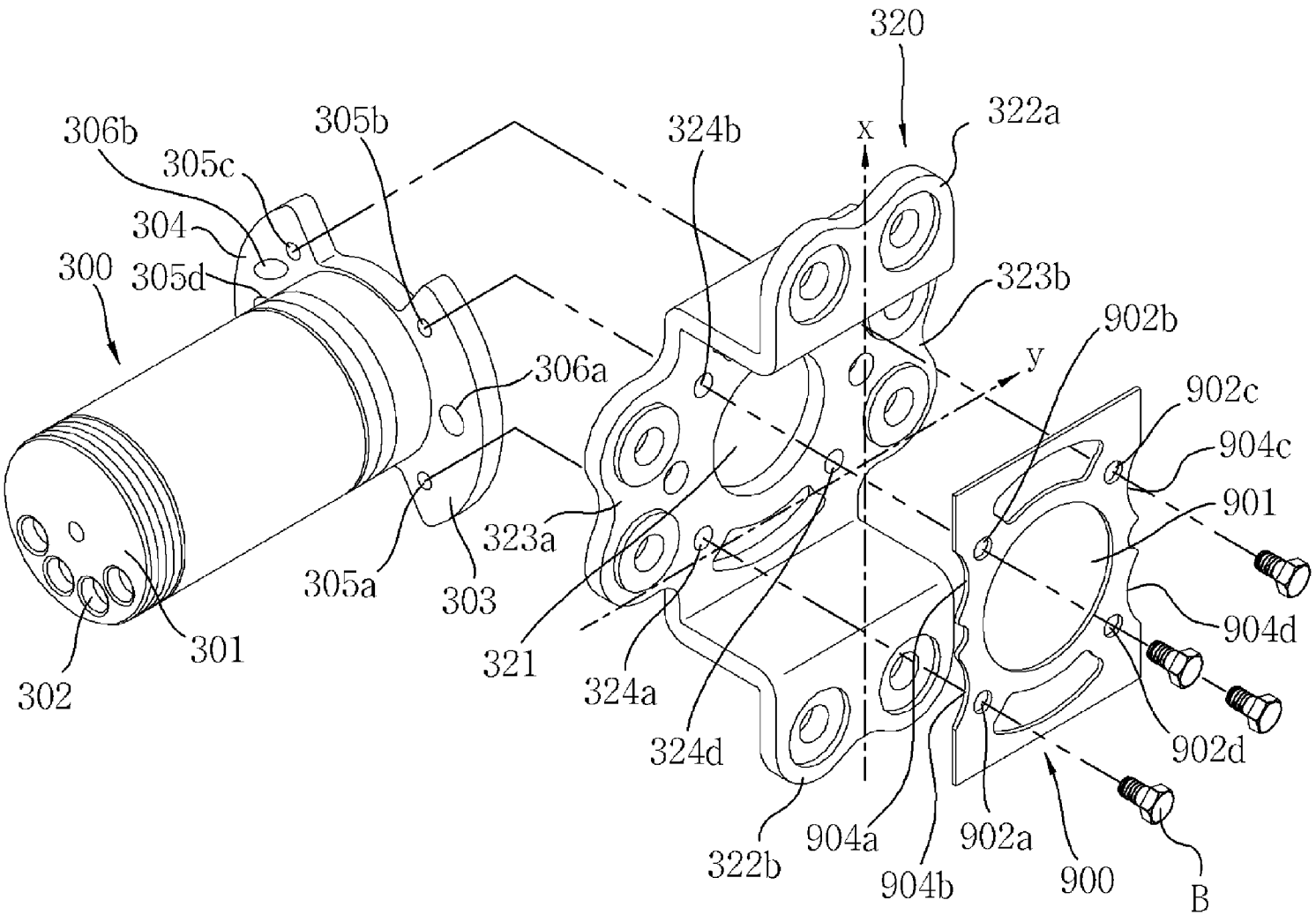
FIG. 7 illustrates a mass member installation structure for a linear compressor in accordance with one embodiment of the present invention.
Figure 8:
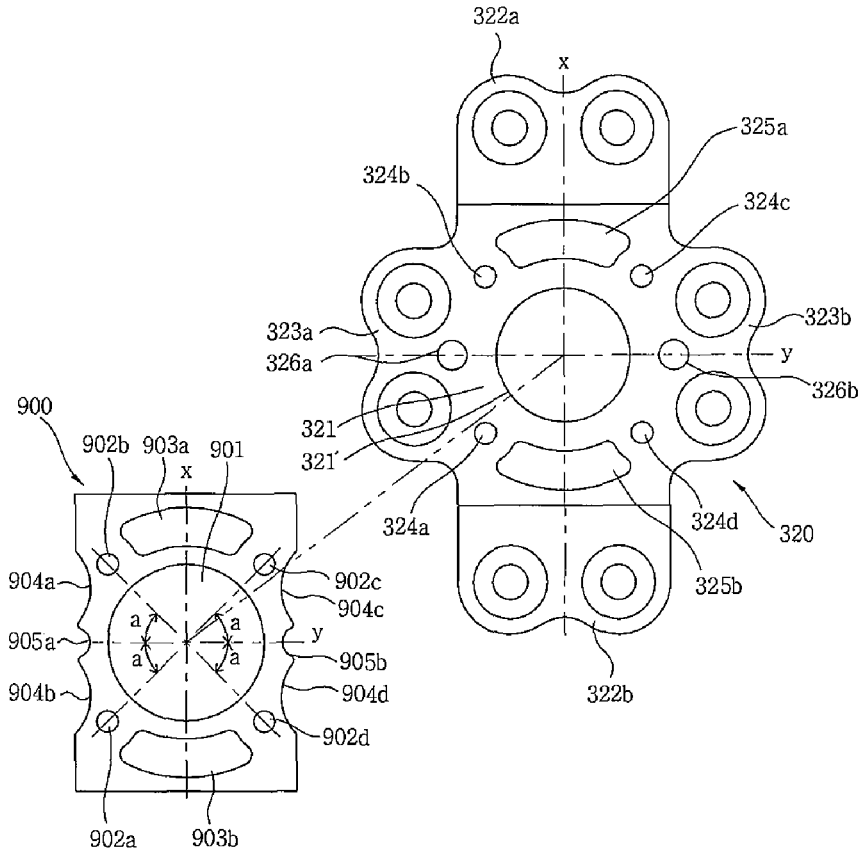
FIG. 8 illustrates one example of a supporter and a mass member which are applied to FIG. 7.
Figure 9:
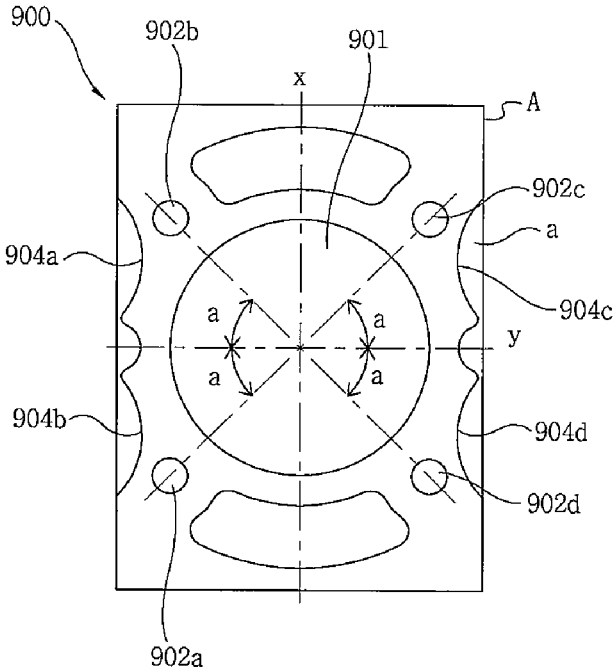
FIG. 9 illustrates a mass member adapted to a linear compressor in accordance with one embodiment of the present invention.

FIG. 7 illustrates a mass member installation structure for a linear compressor in accordance with one embodiment of the present invention, FIG. 8 illustrates one example of a supporter and a mass member which are applied to FIG. 7, and FIG. 9 illustrates a mass member adapted to a linear compressor in accordance with one embodiment of the present invention. One embodiment of a movable member includes a piston 300, a supporter 320, a suction muffler 700 (see FIG. 6), and a mass member 900, and is designed to make a linear reciprocating movement by a linear motor (460, see FIG. 6) and elastically supported in an axial direction by front/rear mainsprings (820 and 840, see FIG. 6).

As an example, the piston 300 has a plurality of suction ports 302 in its closed end 301 and two radially-extending flanges 303 and 304 in its open end on the other side. There are four bolt holes 305*a*, 305*b*, 305*c*, and 305*d* formed in the flanges 303 and 304. Also, the flanges 303 and 304 are constituted by two radially-extending symmetric parts and do not necessarily form one closed structure. The flanges 303 and 304 are formed on both sides, i.e., in the same direction as rear supports 323*a* and 323*b* of the supporter 320 are formed. Moreover, the bolt holes 305*a*, 305*b*, 305*c*, and 305*d* are formed on both sides of the flanges 303 and 304, two holes for each flange, in a manner that they are symmetric to each other not only in the horizontal direction, i.e., in the direction where the rear supports 323*a* and 323*b* of the supporter 320 are formed, but also in the vertical direction, i.e., in the direction where front supports 322*a* and 322*b* of the supporter 320 are formed.

Meanwhile, the flanges 303 and 304 of the piston 300 have guide holes 306*a* and 306*b* for precise assembly of the piston 300, the supporter 320, the suction muffler 700 (see FIG. 6) and the like at their proper install positions.

In one example, the supporter 320 includes a center portion 321 in contact with the flanges 303 and 304 of the piston 300, and a pair of front/rear supports 322*a*, 322*b* , 323*a*, and 323*b* extended in four directions from the center portion 321. The center portion 321 of the supporter 320 has a mount hole 321' the suction muffler 700 (see FIG. 6) passes through, and takes a rectangular shape that is longer in the direction where the front supports 322*a* and 322*b* are formed (x-direction) than in the direction where the rear supports 323*a* and 323*b* are formed (y-direction). The front supports 322*a* and 322*b* of the supporter 320 are two-stage bent from the top and bottom sides of the center portion 321, respectively, both extending backwards and radially along the x-direction. The rear supports 323*a* and 323*b* of the supporter 320 are extended radially from both lateral sides of the center portion 320 of the supporter 320. Since the center portion 321 of the supporter 320 is formed in a rectangular shape, this particular configuration of the supporter 320 is easily achieved simply by bending the front/rear supports 322*a*, 322*b*, 323*a*, and 323*b* along the sides of the center portion 321 of the supporter 320. The front/rear supports 322*a*, 322*b*, 323*a*, and 323*b* of the supporter 320 have supporting protrusions each of which is inserted into the front/rear mainsprings 820 and 840 (see FIG. 6), and each of the supports 322*a*, 322*b*, 323*a*, and 323*d* is mounted with two mainsprings 820 and 840 (see FIG. 6) such that there are four pairs of the front and rear mainsprings 820 and 840 (see FIG. 6).

In addition, the center portion 321 of the supporter 320 has four bolt holes 324*a* , 324*b*, 324*c*, and 324*d* formed between the front and rear supports 322*a*, 322*b*, 323*a* , and 323*b*, at four corners to be more specific in a one-to-one correspondence to the bolt holes of the piston 300.

Furthermore, the center portion 321 of the supporter 320 has a mounting hole 321' through which the suction muffler 700 (see FIG. 6) passes, resistance dissipating holes 325*a* and 325*b* formed above and below the mounting hole 321' to lessen the drift resistance, and guide holes 326*a* and 326*b* formed on both sides of the mounting hole 321' correspondingly to the guide holes of the piston 300.

In one example, a mass member 900 is produced in the same rectangular shape with the center portion 321 of the supporter 320 by cutting a scrap 'a' out of a sheet metal A. To minimize the scrap 'a' being cut out of the sheet metal A, vertical and horizontal ends are formed to maintain an air-gap towards the front supports 322*a* and 322*b* of the supporter 320 and to maintain an air-gap towards the rear mainsprings 840 (see FIG. 6), respectively, in a manner not to get interfered with neighboring components in the rear side of the center portion 321 of the supporter 320. Of course, the mass member 900 may take any one of polygonal shapes depending on the shape of the center portion 321 of the supporter 320, it is preferable to add holes and grooves of diverse shapes to maintain an air-gap towards other neighboring components. Also, to minimize material loss resulted from cutting the scrap 'a' and making a rectangular sheet metal A, it is preferable to make the mass member 900 in a rectangular shape with a 10 mm or less air-gap towards neighboring components in consideration of the assembly tolerance.

The mass member 900 has a mounting hole 901, four bolt holes 902*a*, 902*b*, 902*c* , and 902*d*, and two resistance dissipating holes 903*a* and 903*b* inside. That is, the mounting hole 901 of the mass member 900 is formed at the center in correspondence to the mounting hole 321' of the supporter 320, so that the suction muffler 700 (see FIG. 6) may pass through them. The bolt holes 902*a*, 902*b*, 902*c*, and 902*d* of the mass member 900 are used for bolt-joint between the piston 300 and the supporter 320, so they are formed in four corners of the mass member 900 in a one-to-one correspondence to the bolt holes 324*a*, 324*b*, 324*c*, and 324*d* of the supporter 320. Also, in order to reduce joint deformation, the bolt holes 902*a*, 902*b*, 902*c*, and 902*d* of the mass member 900, similar to the bolt holes 305*a*, 305*b*, 305*c*, and 305*d* of the piston 300 and the bolt holes 324*a*, 324*b*, 324*c*, and 324*d* of the supporter 320, are formed closer to the direction where the rear supports 323*a* and 323*b* of the supporter 320 are formed (y-direction) rather than to the direction where the front supports 322*a* and 322*b* of the supporter 320 are formed (x-direction). Preferably, they are formed at positions at a 45-degree angle (a) with the direction (y-direction) where the rear supports 323*a* and 323*b* of the supporter 320 are formed. Likewise, in order to lessen the drift resistance during the linear reciprocating movement, the resistance dissipating holes 903*a* and 903*b* of the mass member 900 are formed above and below the mounting hole 901 of the mass member 900, where none of the flanges 304 and 305 of the piston 300 are formed yet the holes are positioned correspondingly to the resistance dissipating holes 325*a* and 325*b* of the supporter 320.

The mass member 900 has four mounting grooves 904*a*, 904*b*, 904*c*, and 904*d* and two guide holes or guide grooves 905*a* and 905*b* on both ends. To be more accurate, two mounting grooves 904*a*, 904*b*, and 904*c*, 904*d* are formed on each side of the mass member 900 to enable those four rear mainsprings 840 (see FIG. 6) to maintain an air-gap with each other in settled state. The guide grooves 905*a* and 905*b* of the mass member 900 are formed on both ends, one guide groove on each end, correspondingly to the guide holes 326*a* and 326*h* of the supporter 320 to enable guide pins that are inserted into the guide grooves 905*a* and 905*b* to maintain an air-gap between them. Of course, as the mounting grooves 904*a*, 904*b*, 904*c*, and 904*d* and the guide grooves 905*a* and 905*b* of the mass member 900 have a semicircular or arc shape and one guide groove 905*a* is provided between two mounting grooves 904*a* and 904*b* with respect to one end on one side of the mass member 900, one continuous curved cut portion may be formed consequently.

In addition to the piston 300, the supporter 320, and the suction muffler 700 (see FIG. 6), the mass member 900 is assembled as a part of the movable member. First, the supporter 320, the suction muffler 700 (see FIG. 6), and the mass member 900 are coupled to each other at the rear side of the piston 300, and guide pins of an assembly jig are inserted into the guide holes 306*a* and 306*b* of the piston 300, the guide holes 326*a* and 326*b* of the supporter, and the guide grooves 905*a* and 905*b* of the mass member 300 to secure the components at proper joining positions. Then, the bolt holes 305*a*, 305*b*, 305*c*, and 305*d* of the piston 300, the bolt holes 324*a*, 324*b*, 324*c*, and 324*d* of the supporter 320, and the bolt holes 902*a*, 902*b*, 902*c*, and 902*d* of the mass member 900 are aligned with each other, and bolts B pass through the aligned holes for bolt-joint. The front/rear supports 322*a*, 322*b*, 323*a*, and 323*b* of the supporter 320 are elastically supported by the front/rear mainsprings 820 and 840 (see FIG. 6), and elastic forces of the front/rear main springs 820 and 840 (see FIG. 6) are applied to the flanges 303 and 304 of the piston 300 and the center portion 321 of the supporter 320. At this time, since the mounting grooves 904*a*, 904*b*, 904*c*, and 904*d* that are formed in both ends of the mass member 900 maintain an air-gap towards the rear mainsprings 840 (see FIG. 6) and the upper and lower ends of the mass member 900 maintain an air-gap towards the front supports 322*a* and 322*b*, the mass member 900 is safe from interference of its counterpart. This allows the mass member 900 with a maximum mass to seat in a limited space.

Figure 10:
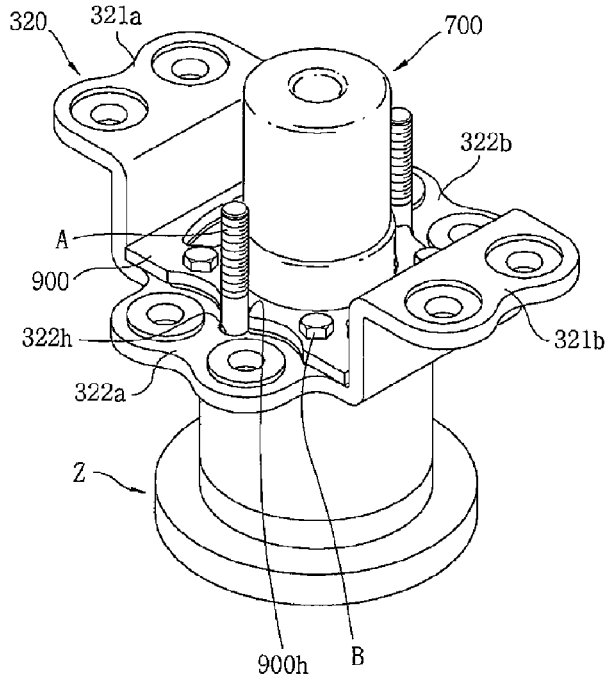
FIGS. 10 through 12 illustrate one example of a movable member assembly structure adapted to a linear compressor in accordance with one embodiment of the present invention.
Figure 11:
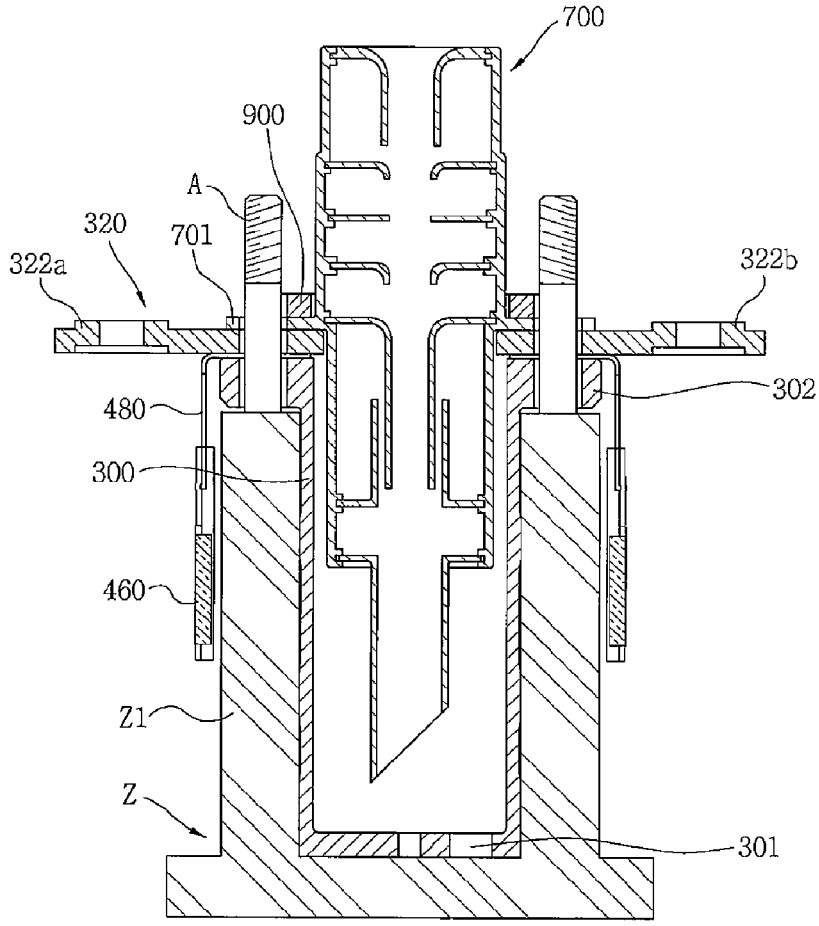
Figure 12:
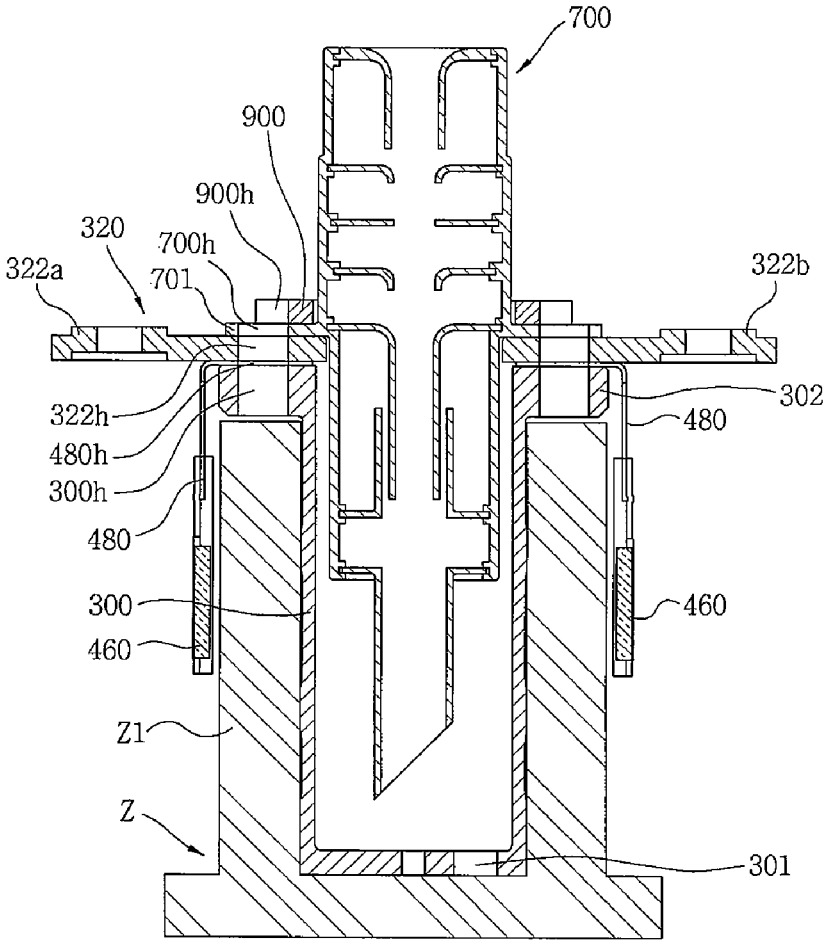

FIGS. 10 through 12 illustrate one example of a movable member assembly structure adapted to a linear compressor in accordance with one embodiment of the present invention. In one example, a movable member includes a piston 300, a connecting member 480 having permanent magnets 460, a supporter 320, a suction muffler 700, and a mass member 900, each of which is assembled in an axial direction. A pair of guide pins A of an assembly jig Z are inserted into guide holes 300*h*, 480*h*, 322*h*, and 700*h* and a guide groove 900*h* formed in the components of the movable member, so as to guide those components to accurate joining positions. The thusly positioned components are then joined together by bolts B. Of course, the movable member linearly reciprocates as one body in an axial direction by drive force from the linear motor 400 (see FIG. 6).

The piston 300 has a refrigerant inlet port 301 on its closed end, and a radially extending flange 302 on its open end. The flange 302 of the piston 300 has four bolt holes (not shown) on the periphery and two guide holes 300*h* between the bolt holes.

The connecting member 480 in a cylinder shape is provided with the permanent magnets 460 which are arranged at regular intervals on the outer periphery of the cylinder in the circumference direction, and its closed end is assembled to cover the flange 302 of the piston 320 from the rear side of the piston 320. The closed end of the connecting member 480 has a hole (not shown) at the center to let the suction muffler 700 pass through it, four bolts holes (not shown) around the hole, and two guide holes 480*h* between the bolt holes.

The supporter 320 includes a pair of front supports 321*a* and 321*b* and a pair of rear supports 322*a* and 322*b* arranged with respect to a rectangular center portion (not shown) thereof in contact with the flange 302 of the piston 300 and the closed end of the connecting member 480, the front supports 321*a* and 321*b* being two-stage bent backwards and radially from two opposite ends of the center portion to elastically support the front main sprints 820 (see FIG. 6), the rear supports 322*a* and 322*b* extending radially from the other two opposite ends of the center portion for elastically supporting the rear mainsprings 840 (see FIG. 6). The center portion of the supporter 320 is settled at the closed end of the connecting member 380 from the rear side thereof, and has a hole (not shown) in its middle portion to let the suction muffler 700 pass through. Also, there are four bolt holes (not shown) around the hole, i.e., within the corners, and two guide holes 322*h* within the rear supporters 322*a* and 322*b*. Needless to say, the bolt holes 300*h* of the piston 300 and the guide holes 480*h* of the connecting member 480 are formed at positions corresponding to the positions of the bolt holes and the guide holes 322*h* of the supporter 320.

The suction muffler 700 is installed in a manner that part of its front end passes through the center portion of the flange 302 of the piston 300, the center portion of the connecting member 480, and the center portion of the supporter 320, and a radially extending connecting part 701 in the middle is settled at the center portion of the supporter 320 from the rear side of the supporter 320. The connecting part 701 of the suction muffler 700 also has four bolt holes (not shown) and two guide holes 700 at positions corresponding to the holes of the supporter 320.

The mass member 900 is added to increase a total mass of the movable member. To have a maximum mass within the limited installation space, the mass member 900 is preferably formed in a rectangular shape same as the center portion of the supporter 302. The mass member 900 is settled at the connecting part 701 of the suction muffler 700 from the rear side thereof. The mass member 900 has a hole (not shown) at the center to let the suction muffler 700 pass through, and there are four bolt holes (not shown) around the hole and two guide grooves 900*h* at positions corresponding to the holes of the supporter 320. In particular, the guide grooves 900*h* of the mass member 900 are formed in an arc shape on both ends of the mass member 900 to cause only counter portions of the guide pins A to be settled.

The piston 300, the connecting member 480 provided with the permanent magnets 460, the supporter 320, the suction muffler 700, and the mass member 900 are assembled with an assembly jig Z. To this end, the assembly jig Z includes a cylinder shape piston holder Z1 to hold the flange 302 of the piston 300 in an inserted state, and a pair of guide pins A that are formed on the upper end of the piston holder Z1 for accurate positioning.

To explain how the movable member is assembled at the assembly jig Z, first, the guide pins A are inserted into the guide holes 300*h* of the piston 300, and the piston 300 is settled on the piston holder Z1 of the assembly jig Z. Next, with the guide pins A being inserted into the guide holes 480*h* of the connecting member 480 having the permanent magnets 460, the connecting member 480 is settled on the flange 300 of the piston 300. The center portion of the supporter 320 is settled on the connecting member 480 to let the guide pins A inserted into the guide holes 320*h* of the supporter 320, and then the connecting member 701 of the suction muffler 700 is settled on the center portion of the supporter 320 to let the guide pins A inserted into the guide holes 700*h* of the suction muffler 700. Lastly, the mass member 900 is settled on the connecting member 701 of the suction muffler 700 to let the guide pins A inserted into the guide grooves 900*h* of the mass member 900. Of course, the permanent magnets 460 that are installed at the connecting member 480 could magnetize the piston 300, the supporter 320, the suction muffler 700, and the mass member 900, but the guide pins A make sure that these components are safely secured at their accurate joining positions. As the components like the piston 300, the supporter 320, the suction muffler 700, and the mass member 900 stay properly positioned for joining, it is easier to join them at accurate positions by fastening bolts B into the bolt holes of those components, thereby enhancing the assembly efficiency. Furthermore, as the guide holes 300*h*, 480*h*, 320*h*, and 700*h* and the guide grooves 900*h* are all formed at the time of sheet metal working or extrusion of components, it does not incur additional material costs and processing costs but reduces an overall cost of manufacturing.

While the present invention has been illustrated and described in connection with the accompanying drawings and the preferred embodiments, the present invention is not limited thereto and is defined by the appended claims. Therefore, it will be understood by those skilled in the art that various modifications and changes can be made thereto without departing from the spirit and scope of the invention defined by the appended claims.

The invention claimed is:

1. A linear compressor, comprising:

a fixed member including a cylinder for providing a refrigerant compression space;

a movable member, which includes a piston for compressing refrigerant inside the cylinder and a supporter composed of a center portion being aligned with a center of the piston and a support portion extended radially of the piston and which makes a linear reciprocating movement about the fixed member;

a plurality of mainsprings supported on the support portion of the supporter, for elastically supporting the piston in an axial direction;

a flange on a rear side of the supporter, wherein the piston includes the flange;

a connecting member, which is coupled between the piston and the supporter and which includes permanent magnets arranged in a circumferential direction;

a suction muffler, which includes a connecting part fastened to the rear side of the supporter and which guides the flow of refrigerant to the piston; and a mass member, which has a rectangular shape corresponding to the center portion of the supporter, wherein the mass member is fastened to a rear side of the connecting part of the suction muffler for increasing a total mass of a linearly reciprocating member in an axial direction; and wherein the flange of the piston, the supporter, the connecting member, and the connecting part of the suction muffler each have at least two guide holes communicating with each other in an axial direction such that guide pins are inserted therein for accurate joining positioning of the components during an assembly process.

2. The linear compressor of claim 1, wherein the supporter includes at least two front supports that are two-stage bent to extend backwards and in a radial direction from the center portion, and at least two rear supports extended radially from the center portion, wherein the mainsprings are composed of a plurality of front mainsprings that are supported on the fixed member and the front supports, and a plurality of rear mainsprings that are supported on the fixed member and the rear supports, and wherein the mass member includes at least four ends to maintain an air-gap towards the front supports and towards the rear mainsprings.

3. The linear compressor of claim 2, wherein, for a bolted-joint with the piston and the supporter, the mass member further includes a plurality of bolt holes between the ends provided to maintain an air-gap towards the rear mainsprings and between the ends provided to maintain an air-gap towards the front supports.

4. The linear compressor of claim 2, wherein the mass member further includes a plurality of resistance dissipating holes inside the ends that are provided to maintain an air-gap towards the front supports, thereby reducing drift resistance.

5. The linear compressor of claim 2, wherein the mass member further includes a plurality of mounting grooves at the ends that are provided to maintain an air-gap towards the rear mainsprings, thereby enabling installation of the rear mainsprings.

6. The linear compressor of claim 1, wherein the mass member further includes guide grooves that are formed in the ends to maintain an air-gap towards guide pins.

7. The linear compressor of claim 1, wherein the mass member further includes guide holes at positions corresponding to the guide holes of the supporter.

8. The linear compressor of claim 1, wherein the center portion of the supporter has a polygonal shape, the center of which is aligned with the center of the piston.

9. The linear compressor of claim 1, further comprising: a linear motor, which includes an inner stator secured to the outer periphery of a cylinder, an outer stator installed at a predetermined distance away from the inner stator in a radial direction, and the permanent magnets installed between the inner stator and the outer stator having an air-gap between them, the permanent magnets linearly reciprocating in an axial direction by an interactive electromagnetic force.

10. The linear compressor of claim 2, wherein the center portion of the supporter is formed in a rectangular shape longer in a direction where the front supports are formed than in a direction where the rear supports are formed.

11. The linear compressor of claim 1, wherein the mass member includes guide holes or guide grooves at positions corresponding to guide holes on the side of the connecting part of the suction muffler.

12. The linear compressor of claim 1, wherein the supporter includes a polygonal center portion aligned with the center of the piston, at least two front supports that are two-stage bent to extend backwards and in a radial direction from the center portion, and at least two rear supports extended radially from the center portion, and wherein the guide holes of the supporter are formed between the center portion and the rear supports.

* * * * *